US006060095A

United States Patent [19]

Scrimager

[11] Patent Number: 6,060,095

[45] Date of Patent: May 9, 2000

[54] MICROWAVE POPCORN SERVING PACKAGE

[75] Inventor: Cynthia Scrimager, Anaheim, Calif.

[73] Assignee: Hunt-Wesson, Inc., Fullerton, Calif.

[21] Appl. No.: 08/950,278

[22] Filed: Oct. 14, 1997

[51] Int. Cl.[7] ..... B65D 81/34

[52] U.S. Cl. ..... 426/107; 426/111; 426/113; 426/115; 426/118; 426/122; 426/123; 426/234; 426/243; 426/395; 383/200; 383/205; 383/207; 383/209; 219/729

[58] Field of Search ..... 426/107, 111, 426/112, 113, 115, 118, 122, 123, 234, 243, 395; 383/200, 205, 207, 208, 209; 229/87.05; 219/729

[56] References Cited

U.S. PATENT DOCUMENTS

| | | | |
|---|---|---|---|
| 2,306,335 | 12/1942 | Feigenbutz | 383/207 |
| 2,684,807 | 7/1954 | Gerrish | 383/66 X |
| 4,292,332 | 9/1981 | McHam | 426/111 |
| 4,571,337 | 2/1986 | Cage et al. | 426/107 |
| 4,596,713 | 6/1986 | Burdette | 426/107 |
| 4,638,911 | 1/1987 | Prohaska | 383/205 |
| 4,904,488 | 2/1990 | LeBaw et al. | 426/107 |
| 5,100,003 | 3/1992 | Jud | 229/87.05 |
| 5,203,634 | 4/1993 | Kim | 383/205 |
| 5,335,996 | 8/1994 | Cortopassi et al. | 383/207 |
| 5,460,839 | 10/1995 | Archibald | 426/107 |
| 5,461,216 | 10/1995 | McDonald et al. | 426/107 X |
| 5,473,142 | 12/1995 | Mass | 426/107 X |
| 5,507,579 | 4/1996 | Sorenson | 383/207 |
| 5,770,839 | 6/1998 | Ruebush et al. | 426/234 X |

FOREIGN PATENT DOCUMENTS

| | | | |
|---|---|---|---|
| 0 294 087 A2 | 12/1988 | European Pat. Off. | B65D 81/34 |
| 96/09967 | 4/1996 | WIPO | B65D 17/00 |

OTHER PUBLICATIONS

European Search Report dated Feb. 18, 1999.

Two (2) sheets of drawings illustrating Hunt–Wesson popcorn package.

*Primary Examiner*—Milton Cano

*Attorney, Agent, or Firm*—Pretty, Schroeder & Poplawski

[57] ABSTRACT

An expandable microwave popcorn package which contains a charge of popcorn kernels for preparation in a microwave oven. The package is formed of front and back panels preferably joined together at the top and bottom ends by an adhesive and at the sides by side panels. The back panel includes a pair of separation lines along which the package material is relatively weak such that a portion of the back panel can be torn from the remainder of the package to expose the popcorn within. Separation lines may be formed by weakening a portion of the bag substrate, by reinforcing the adjacent areas, or by a combination of the two. Side panels are folded to form gussets which allow the package to remain flat during storage, to expand to accommodate the popped kernels. A susceptor is also preferably placed on the front panel opposite the back panel to enhance the popping action.

20 Claims, 6 Drawing Sheets

MICROWAVE POPCORN SERVING PACKAGE

FIELD OF THE INVENTION

The present invention relates to an expandable package containing a charge of popcorn kernels to be prepared in a microwave oven. More particularly, this invention relates to a multi-purpose package which can be converted to a convenient serving container after the kernels have been popped.

BACKGROUND OF THE INVENTION

Microwavable popcorn has become a very popular snack item, convenience being a major factor in its popularity. Microwave popcorn can be stored in a ready-to-use, shelf-stable, leak-proof package, which serves as the cooking container. These packages are designed to store a charge of edible ingredients, including popcorn kernels, shortening and optional seasonings or flavorings, in a collapsed condition that reduces required storage space and shipping costs. When these packages are exposed to microwave energy they expand to accommodate the increasing volume of the popcorn within.

One currently available package that can be used to prepare popcorn in a conventional microwave oven is described in U.S. Pat. No. 4,571,337 to Cage. It is a traditional flat-bottom, gussetted bag that controls venting of steam during cooking and allows the top end to be opened by pulling on diagonally opposite corners. Another common package style is the wedge-bottom, or pinch bottom bag, illustrated in U.S. Pat. No. 4,596,713 to Burdette. In this package the edges of the front and back panels are joined by two gussetted side panels. The top and bottom ends are both sealed by crimping. There is no bottom panel. The interior of the bag is divided into two food compartments. This package is likewise opened at the top end after cooking to provide access to the contents within. The ends of the package can be sealed by bonding the edges of each of the panels with a high temperature adhesive. Each side panel includes inward folds that form gussets, which extend into the interior of the package.

Prior to cooking, the charge of kernels and other edible ingredients has a relatively small volume, allowing the gussets to remain folded inwardly so that the package assumes a relatively flat shape. Moreover, since the upper and lower ends remain relatively empty of kernels, they are easily flattened and folded over the more bulky center section, thereby keeping the charge of kernels centered in the middle portion of the package.

Most microwavable popcorn containers sold today include a susceptor, which is incorporated in the panel of the package that rests on the floor of the oven, underneath the charge. The susceptor converts microwave energy to thermal energy, thereby starting the popping process and introducing steam to the interior of the package by causing the first kernels to pop. The use of a susceptor generally results in larger pop volume and fewer unpopped kernels. Susceptors are sometimes combined with multiple gussets in each side panel for still greater pop volume.

When the still folded package is to be cooked, it is placed inside the microwave oven with the center section of the front panel resting on the oven floor, so that the charge of popcorn rests squarely on the susceptor to the maximum extent. During cooking, the internal pressure of steam released by the kernels and the increased volume of the popped kernels causes the two end sections to gradually unfold. As the process continues, the gussets also unfold allowing the package to approach its full volume. This process continues until substantially all of the kernels have popped, or until the early pops are in danger of scorching, at which time the package is removed from the oven. The optimum oven time depends on the characteristics of the particular oven and the popcorn kernels used, e.g., their moisture content.

Traditional packages leave something to be desired as to the convenience with which the edible popcorn is accessed. After the popcorn has been prepared, one end of the package must be opened, usually by pulling opposing corners, as described in U.S. Pat. No. 4,571,337. Then the consumer can either pour the contents into a separate serving bowl, or the popcorn can be eaten directly from the package. If the consumer does not wish to use or does not have available a separate container into which to empty the package, eating directly from the package is a viable but messy option. The consumer may not be able to reach the popcorn at the bottom of the package without coming into contact with shortening or grease that tends to coat the inside surfaces of the package. Moreover, if the consumer wishes to add toppings, such as butter or caramel, to the corn after popping, it will be very difficult to apply a well distributed coating through the open end of the package.

In view of the foregoing, it should be appreciated that there is a need for an improved microwave popcorn package that can be used not only for the storage and preparation of popcorn, but which also can be converted into a convenient serving vessel that provides direct and easy access to the edible popcorn within.

SUMMARY OF THE INVENTION

This invention pertains to a multi-purpose microwave popcorn package for storing a charge of unpopped corn kernels, expanding to accommodate the increased volume of popcorn as it is popped in response to the application of microwave energy, and ultimately for conveniently serving the resulting edible popcorn without using an additional container. In combination with the other features described below, this package provides increased convenience and cleanliness for the user at no significant extra cost. These objectives are accomplished with a design that is simple and inexpensive to manufacture.

The primary structural components of the package include a front panel, a back panel and two side panels which join the front and back panels. In a wedge-shaped package, the top and bottom ends of the front and back panels can be connected, thereby forming a closed, sealed package within which a charge of popcorn is contained. Extending from the top end to the bottom end of the back panel are two elongated strips of comparatively low tear strength, otherwise known as separation lines. These separation lines divide the back panel into three sections: a middle section and two outer sections.

An important feature of this invention is that after the corn has been popped and the package has expanded to accommodate the increased volume, the middle section of the back panel can be readily separated from the remainder of the adjacent outer sections. For this purpose, the top end of each separation line begins with an incision to initiate controlled tearing of the back panel along these lines. Pulling the top end of the middle section away from the remainder of the package causes the back panel to start tearing at the base of each incision and to continue along the predetermined separation lines. Ultimately, the middle section is peeled back or removed completely and the package then forms a convenient bowl-like container for serving the popcorn.

In one of the embodiments of the invention the package includes two outer reinforcement strips adhered to the outer sections immediately adjacent the separations lines. These reinforcement strips add strength and tear resistance to the linear portions of the back panel to which they are attached. Thus when the middle section is pulled away from the outer sections, the tear line will be predictably contained between the outer reinforcement strips rather than extending outwardly onto the outer sections and the adjacent side panels. Since the outer sections of the back panel will remain intact and will continue to support the side panels, the package will retain its shape and structural integrity after the middle section has been removed.

Another aspect of the invention relates to two inner reinforcement strips which can function in conjunction with the outer reinforcement strips. These inner strips can be applied to the back panel along the outer edges of the middle section. As with the outer reinforcement strips, these inner reinforcement strips increase the strength of the portion of the middle section to which they are attached. Thus a pair of separation lines can be defined between portions of the front panel that have comparatively greater strength.

The reinforcement strips can be made of pressure-sensitive tape cut to the length of the back panel. This feature can provide a simple and economical means by which to reinforce certain areas of the package without compromising the integrity of the back panel itself, as occurs if the panel is intentionally weakened along the separation lines by, for example, creating a score line or perforation line.

According to still another aspect of the invention, a single strip of reinforcing material can be used to define each separation line by reinforcing the adjacent material. The reduced structural integrity of the separation lines can be accomplished by forming perforations along the longitudinal center line of the tape. Since the unperforated portions of the reinforcement strips strengthen the adjacent edges of the middle and outer sections, the tears will be controlled and will follow the line of the perforations. As with the dual reinforcement strips, these single reinforcement strips may be made of pressure-sensitive tape.

It is also possible, in accordance with the invention, to utilize partial or complete perforations or score lines in the back panel itself to reduce the strength of the panel along the separation lines. Since the back panel itself thus defines the areas of relatively low strength and resistance to tearing, the package does not require additional reinforcement strips to build up the adjacent areas. The package may also include a pair of cover strips adhered to the back panel over the perforations. These cover strips can prevent leakage of oils or seasoning through perforations, and add enough structural stability to ensure that the back panel does not split open along the separation lines during handling or while it is expanding in the microwave oven.

Another embodiment of the of the invention combines the advantages of the outer reinforcement strips with scores in the back panel. The strips are adhered to the outer sections immediately adjacent the intended separation lines, and score lines are impressed in the back panel immediately adjacent the inner edges of the strips. Optionally, the package may also include inner reinforcement strips placed along the edges of the middle section adjacent the score lines, as previously described. These arrangements provide redundancy to further ensure that when the middle section is removed, the tears will travel along the desired separation lines.

Another aspect of the present invention utilizes multiple gussets formed by each side panel to increase both the popping efficiency and the accessability of the interior of the resulting container. Each side panel is folded to form multiple smaller gussets rather than a single large gusset. Since these smaller gussets extend into the package to a lesser extent, they do not have a tendency to interfere with the popping process to the same extent as single gussets. Moreover, after the middle section has been removed, it will be easier for the consumer to reach into the package without contacting the side walls, which will likely be coated with shortening and seasoning.

According to another aspect of this invention, the separation lines are located directly adjacent the inner edges of the gussets. When the package is fed through rollers to crease the folded gussets and seal the ends, and when the package is handled later, the varying thickness at the fold line tends to create natural score lines or weakened areas along the sections of the front and back panels at this location. Thus if the separation lines are placed along these natural score lines there will be less need for reinforcement or additional weakening to form the separation lines.

An alternative embodiment takes advantage of the same natural score lines by placing the separation lines anywhere between, if not on, the inner gusset folds. Thus if the tear deviates from the intended separation line, it will tend to follow the inner edge of a gusset.

Another aspect of the present invention is the use of a susceptor to increase the efficiency and completeness of the popping process. Since the separation lines, pull tab, etc. are located on the back panel, the front panel is free to accommodate the susceptor.

Other features and advantages of the present invention will become apparent from the following description of the preferred embodiments, taken in conjunction with the accompanying drawings, which illustrate, by way of example, the principles of the invention.

DESCRIPTION OF THE PREFERRED EMBODIMENT

Figure 1:
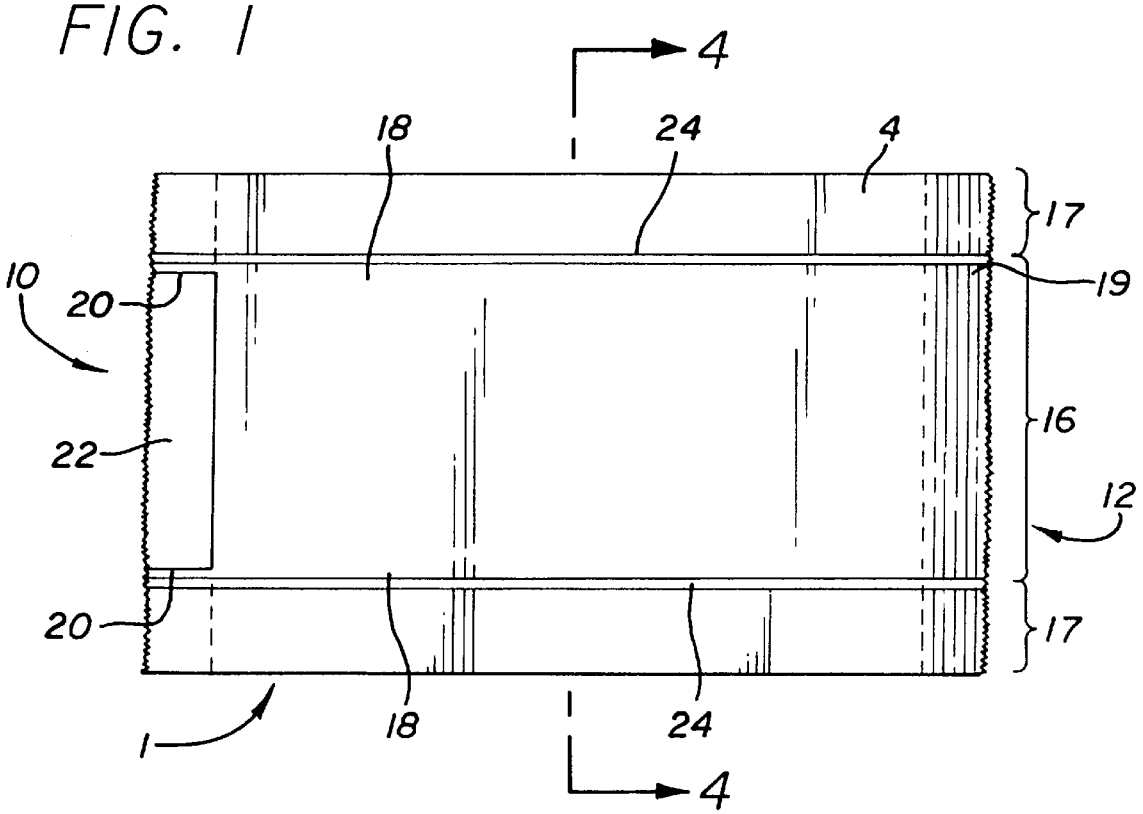
FIG. 1 is a plane view of the package of the invention, illustrating a preferred embodiment with outer reinforcement strips adhered to the outer sections of the back panel and score lines defining the separation lines.

The present invention relates to an exemplary microwave popcorn product, generally indicated as 1 in the accompanying drawings. The package 1 contains a charge of popcorn kernels 14 that expand into puffed edible popcorn 15 during preparation in a microwave oven. The package 1 can also serve as a vessel from which the popcorn 15 can be conveniently removed and eaten, and which allows users to conveniently add toppings to the prepared popcorn without first removing it from the package.

As shown in FIGS. 1–4, the primary structural components of the package 1 include a rectangular front panel 2, a rectangular back panel 4, and two rectangular side panels 6 and 8 which connect the sides of the front and back panels. Various sheet materials may be used to form the panels, so long as the basic requirements of the package 1 are met. The package must be stiff enough to generally maintain its expanded shape without tearing while the popcorn is being prepared, but at the same time it must be flexible enough that the internal steam and popcorn volume can expand the package from its compressed configuration. Additionally, the material should be resistant to leakage or staining before, during or after popcorn preparation. A two-ply construction with an inner grease-proof layer of 20–25 lbs, and an outer machine finished paper layer of 20–25 lbs is suitable. A suitable material for a single ply package is a paper approximately 0.5 to 1.0 mils thick with a weight of about 35–60 lbs. Machine glazed papers are also suitable, but can be too rigid if they are too thick. The surface of the paper is treated with a commercially available fluorocarbon stain inhibitor.

All four panels define a top end generally indicated by 10 and a bottom end generally indicated by 12. Both ends of front panel 2 and back panel 4 must be joined to close package 1 and fully contain popcorn 14 and other ingredients. The preferred way to close the ends is to use the "tube" method in which a heat sensitive adhesive strip (not shown) is applied to the inner surfaces near both ends of the panels. When it is desired to close the ends, they are simply placed in a heated press which squeezes them together at an elevated temperature. Typical adhesives are polyvinyl acetate or polyethylene vinyl acetate, suited for high temperature applications. An alternative construction for the bottom end of package 1 includes an additional bottom panel (not shown). An example of this type of package is described in U.S. Pat. No. 4,571,335, which is incorporated by reference. However, tube construction is more compatible with the conversion of package 1 into a bowl after the popping has been completed, as explained below.

Figure 2:
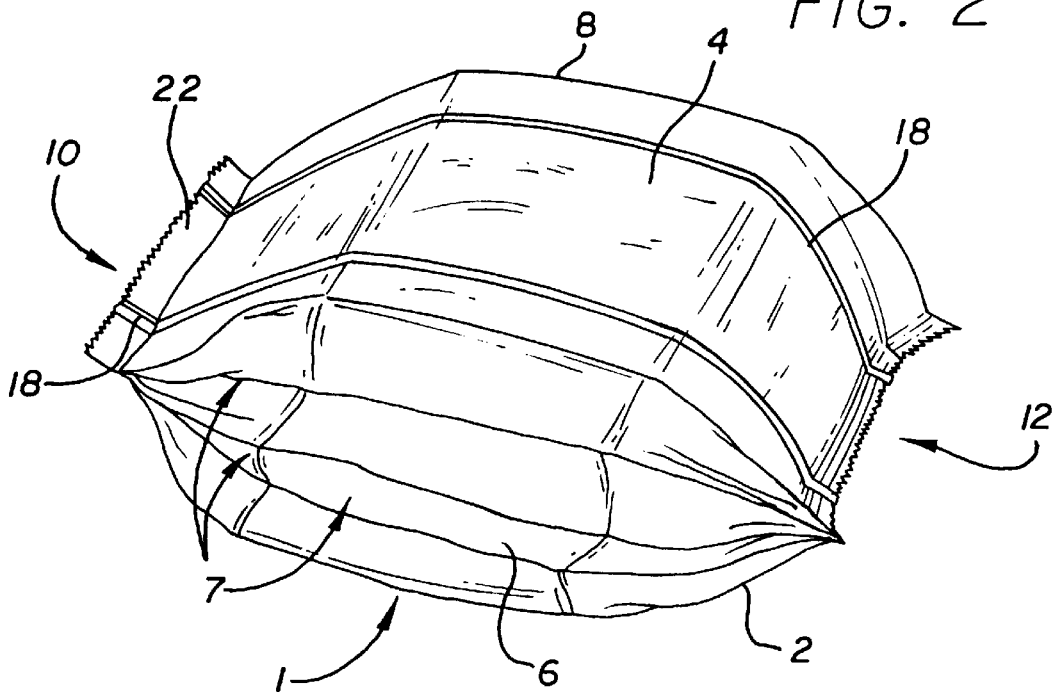
FIG. 2 is a pictorial illustration showing the package of FIG. 1 in perspective, after it has been expanded by popping the corn.
Figure 3:
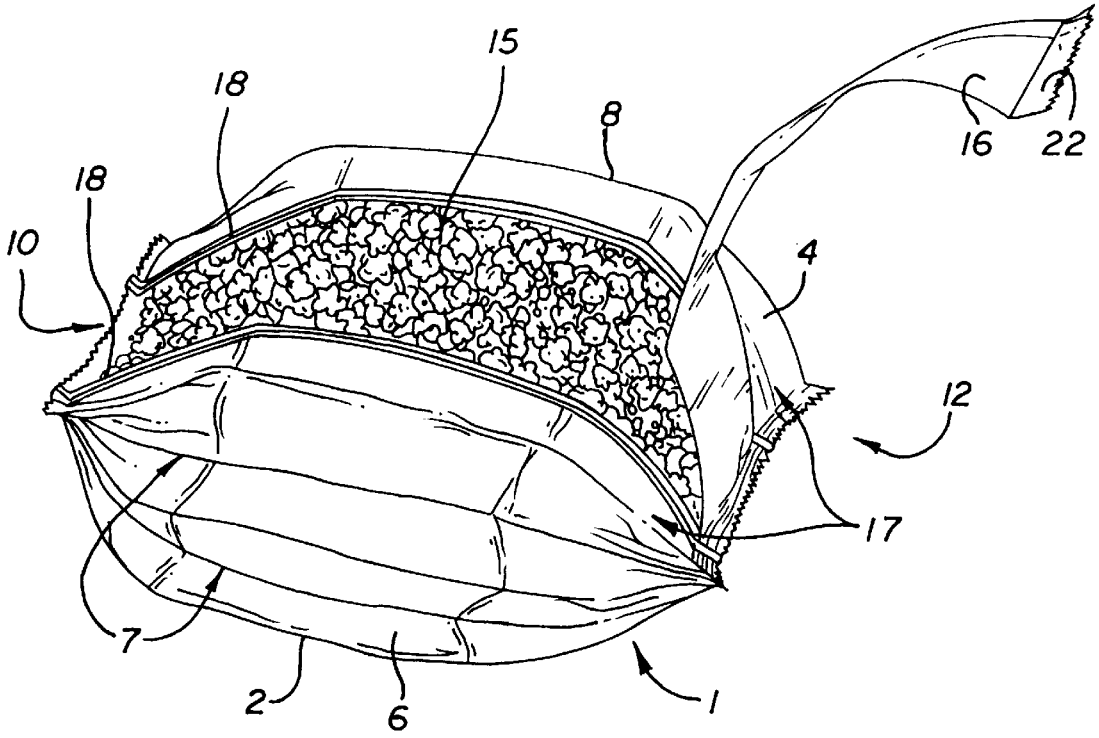
FIG. 3 is a pictorial illustration, similar to FIG. 2, after the middle section of the back panel has been removed to allow access to the prepared popcorn within.
Figure 4:
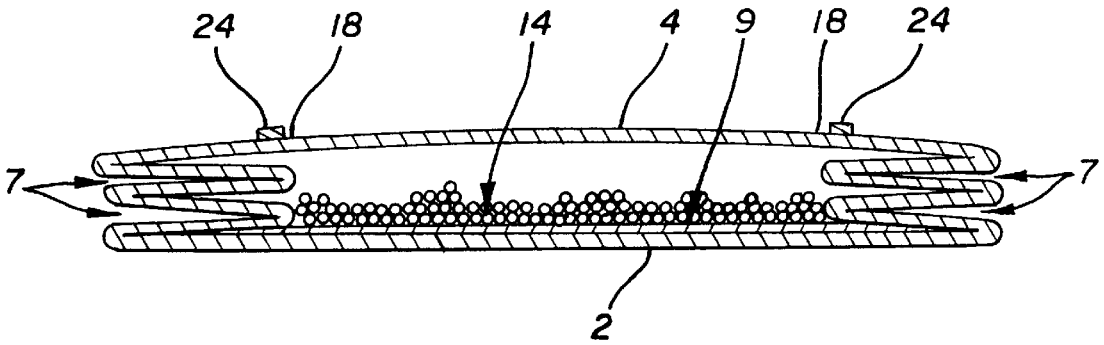
FIG. 4 is a cross-sectional side view of the package taken along the line 4—4 of FIG. 1.

As best shown in FIG. 4, the side panels 6, 8 of the package 1 include gussets 7 which allow the package 1 to maintain a collapsed configuration prior to the preparation of the popcorn 14. Two gussets 7 are formed in each side panel by creating multiple inward folds along the longitudinal axis of the package 1 that give the side panel a pleated or accordion-like configuration. The stiffness of the side panel material causes the gussets 7 to remain compressed so that the package 1 stays relatively flat during storage and shipment. When microwave energy is applied, however, the side panel material is flexible enough to allow the gussets 7 to expand to accommodate the increased volume of the expanded popcorn 15 (as illustrated in FIGS. 2–3). The use of two or more gussets 7 on each side is preferred, for reasons explained below.

The contents of the package 1 principally include a charge of unpopped kernels 14 which expand into the popped kernels 15 that fill the expanded volume of the package. Also included in the charge 14 is a quantity of shortening and seasonings to enhance the flavor and texture of the resulting popcorn 15. Room temperature stable shortening is selected so that refrigeration is not required, and the charge 14 is solid at room temperature.

Referring again to the cross-sectional view of FIG. 4, this embodiment also includes a susceptor 9 adhered to the front panel 2 to enhance popping performance. A susceptor is a thin sheet of material, usually formed of a metal, such as aluminum, that, when subjected to microwave energy, rapidly increases in temperature, thereby raising the temperature within the package. Susceptors are important to popping efficiency as an ideal package would pop all of the kernels in the shortest time possible. The mechanics of popping corn depend on several factors, such as the size of the kernels, the thickness of the outer shells of the kernels, and the moisture content within the inner portion of the kernel. Ideally, all of the kernels within a particular package fall within a very tight range of these variables so that they will all pop at about the same time, thus preventing the earlier popped kernels from scorching as cooking continues. Susceptors tend to keep the lag time between the early and late pops as short as possible. They also increase pop volume and decrease the number of "unpops."

When the charge of popcorn kernels 14 has been popped, a rectangular middle section 16 of the back panel 4 can be removed, thereby forming a vessel suitable for conveniently serving the popped popcorn 15 (as illustrated in FIG. 3). Referring in particular to FIGS. 1 and 4, the back panel 4 includes two parallel separation lines 18 located approximately adjacent the innermost edges of the side panel gussets 7. These separation lines 18 are narrow strips of material which have lower strength than the immediately adjacent package material. The purpose of the separation lines 18 is to allow a user to tear the middle section 16 of the back panel 4 off the package 1, leaving a usable open-topped vessel that retains its shape. If a tear were to stray outward from the separation lines 18, it could weaken the outer sections 17 and possibly the side panels 6 and 8, thereby greatly reducing the overall structural integrity of the package 1 and causing package to lose its shape and definition. Alternatively, if the tears were to stray onto the middle section 16 the opening left behind might be too small to allow a consumer good access to the interior of the package 1.

As shown in FIG. 1, the back panel 4 further includes two small incisions 20 at the top end of each separation line 18. These incisions 20 serve the dual purposes of initiating any tearing of the back panel 4 along the separation lines 18 and of forming a pull tab 22 from the portion of the back panel 4 between them. Ideally the backside of the pull tab 22 does not have any adhesive applied to it so that it remains free of the front panel 2. Thus, the consumer can use the pull tab 22 to grip the top of middle section 16 when tearing it off. However, at least some adhesive should be applied on the portion of the back panel 4 just below the pull tab 22 so that the end 10 of the package 1 is sealed across its entire width. Otherwise the unpopped kernels 14 may escape during storage, or the popped kernels 15 and steam might escape prematurely during the popping process.

Experimentation has shown that after a package of popcorn has expanded to accommodate the popped volume, any tears initiated along the longitudinal axis of one panel tend to turn outwardly toward the outer sections of that panel as well as to the adjacent panels due to the transverse stresses placed on the package. Thus if one wished to remove just the rectangular middle strip 16 from the package 1, guides should be included to direct the tears along the separation lines 18 toward the bottom end 12 of the package 1. Such guides can be constructed in various ways. The material adjacent the separation lines 18 can be reinforced relative to the material along the separation lines, the material along the separation lines can be weakened relative to the adjacent material, or the package may include a combination of these structures.

Preferably, the separation lines 18 coincide with the inner edges of the folded gussets 7 (as illustrated in FIG. 4). Packages tend to be naturally weakened along these lines during the manufacturing and filling process, and possibly during subsequent handling, due to the abrupt change in thickness of the package, leading to the breakage and separation of fibers. The greater the number of gussets, and hence the greater thc difference in thickness, the more pronounced this effect will be. In general, the inter-gusset dimension of a single gusset package will be too small to permit separation lines to be placed along the gusset edges, so this construction is not preferred, but may be used.

The preferred embodiment of the invention illustrated in FIGS. 1–4 includes two outer reinforcement strips 24 of pressure sensitive tape applied to the back panel 4 to reinforce the edges of the outer sections 17 immediately adjacent the intended separation lines 18 and in alignment with the incisions 20. The material forming the reinforcement strips 24, and the adhesive securing the strips, should be capable of withstanding temperatures up to 350° F. Preferred materials for the reinforcement strips include polypropylene or oriented polyethylene teraphthalate ("PET") materials. The strips 24 are applied to the package 1 by tape dispensers which roll the tape onto the surface of back panel 4 as the package passes through manufacturing machines. After the reinforcement strips 24 have been applied to the substrate of the package 1, additional rollers may be utilized to apply increased pressure thereby assuring proper adhesion.

The material of the back panel 4 itself is also preferably weakened along separation lines 18. This can be accomplished by impressing score lines 32 onto the material of the back panel adjacent the outer reinforcement strips 24. These score lines 32 will then define the separation lines 18. This redundant arrangement provides further incentive for the tears to extend along the intended path of the separation lines 18.

Another embodiment of the present invention illustrated in FIGS. 11–14 also includes two inner reinforcement strips 26 of pressure sensitive tape applied along the edges of the middle section 16 adjacent the desired separation lines 18. Thus each separation line 18 will be located in a channel formed between the inner and outer reinforcement strips that guide and control the tearing action. Score lines 32 may be added to this embodiment, and similar materials and application processes may be used for the inner reinforcement strips 26 as are used for the outer reinforcement strips 24. Note, however, that the addition of the inner reinforcement strips 26 will not be necessary in most cases. This is because, as described above, the natural tendency is for longitudinal tears in the back panel 4 to turn outwardly. Thus, the additional protection provided by inner reinforcement strips 26 will usually be called for only in relatively high-end popcorn packages.

Figure 5:
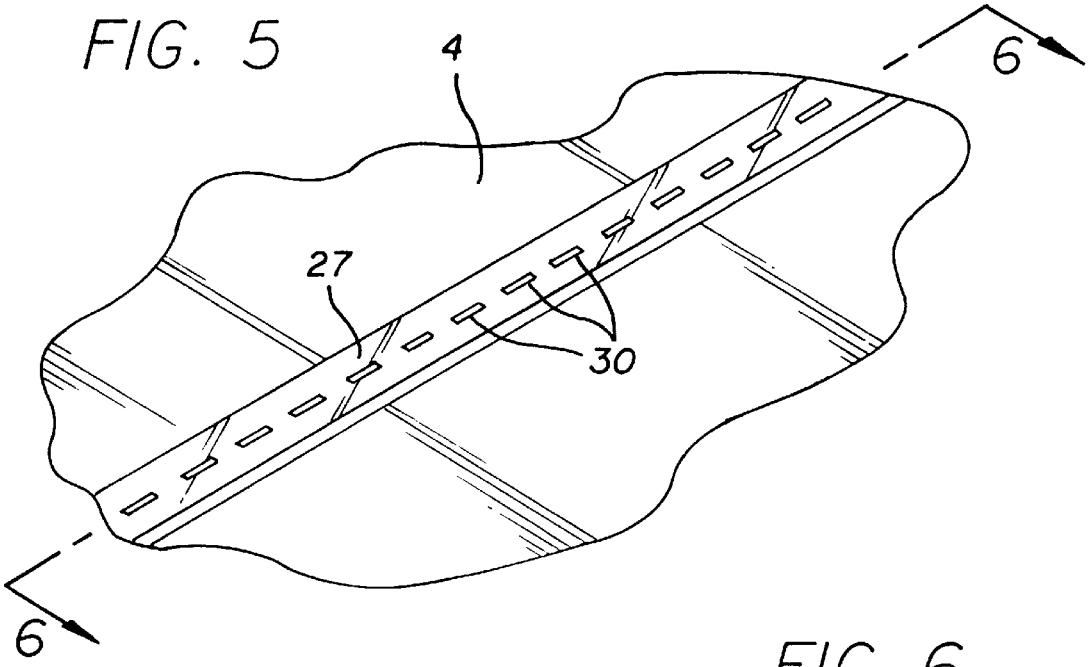
FIG. 5 is a top elevational view of an embodiment of the invention in which each separation line is formed by a relatively wide reinforcement strip with a perforated centerline.
Figure 6:
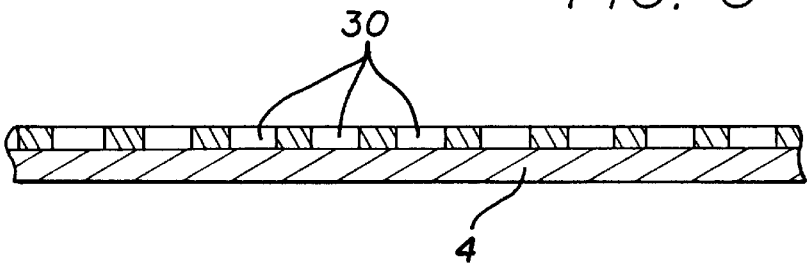
FIG. 6 is a cross-sectional view taken along the line 6—6 of FIG. 5.
Figure 7:
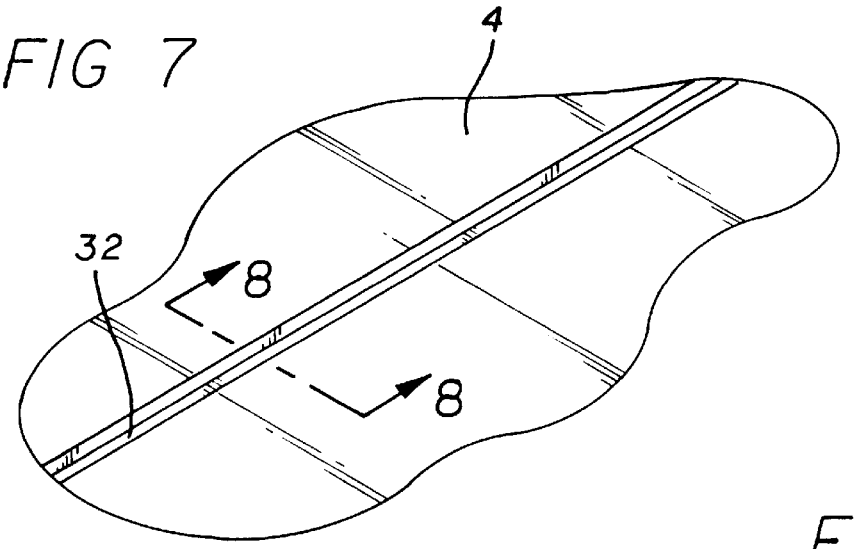
FIG. 7 is a top elevational view of an additional embodiment of the invention in which each separation line is defined by an elongated score line in the back panel.
Figure 8:
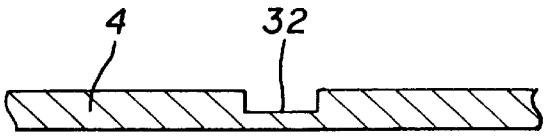
FIG. 8 is a cross-sectional view taken along the line 8—8 of FIG. 7.

In another embodiment of the present invention, illustrated in FIGS. 5 and 6, a single strip 27 of pressure sensitive tape is applied to the back panel 4 along each separation line 18. These strips 27 are wider than those used in the earlier described embodiment, shown in FIGS. 1–4, so that the edges overlap considerably onto the adjacent middle section 16 and the outer sections 17 that form the remainder of the back panel 4. A series of perforations 30 is formed near the centerline of each strip 27, thereby weakening the center of the strip relative to the outer portions. The perforations 30 are placed in alignment with, and preferably extend slightly into, the incisions 20 so that when the middle section 16 is torn off, the tears will be initiated at the incisions and travel along the perforations. Again these reinforcement strips 27, and the adhesive used to apply them, should be able to withstand relatively high temperatures of up to approximately 350° F.

Figure 9:
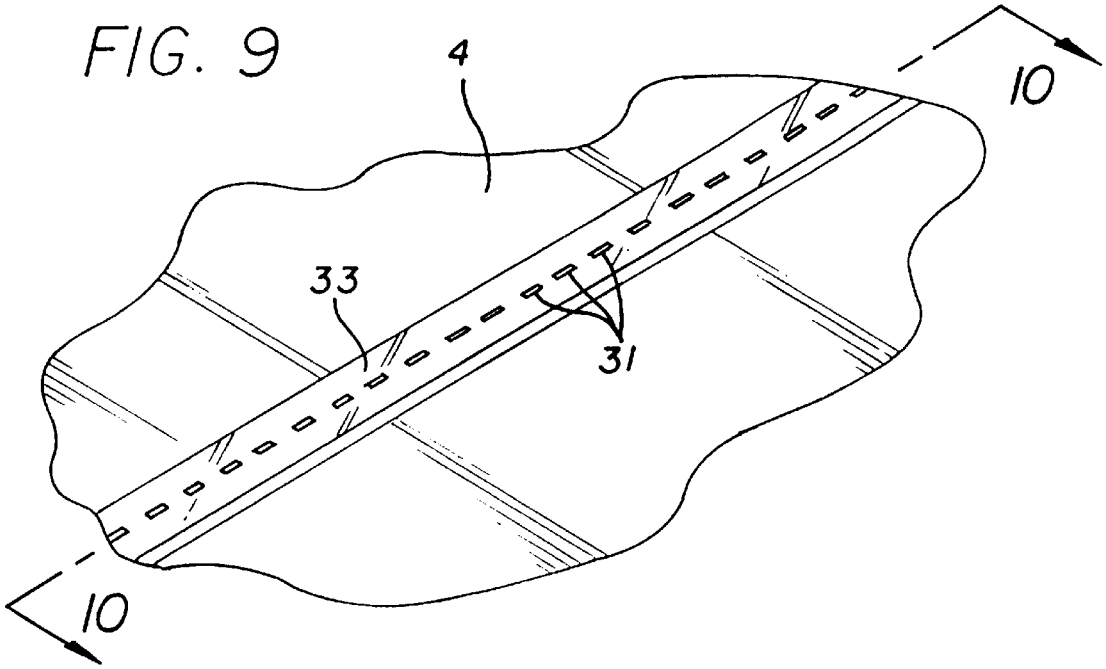
FIG. 9 is a top elevational view of another embodiment of the invention in which each separation line is formed by a series of perforations in the back panel scaled by a cover strip.
Figure 10:
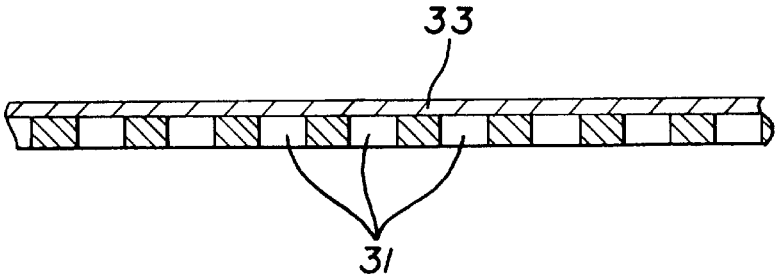
FIG. 10 is a cross-sectional view taken along the line 10—10 of FIG. 9.
Figure 11:
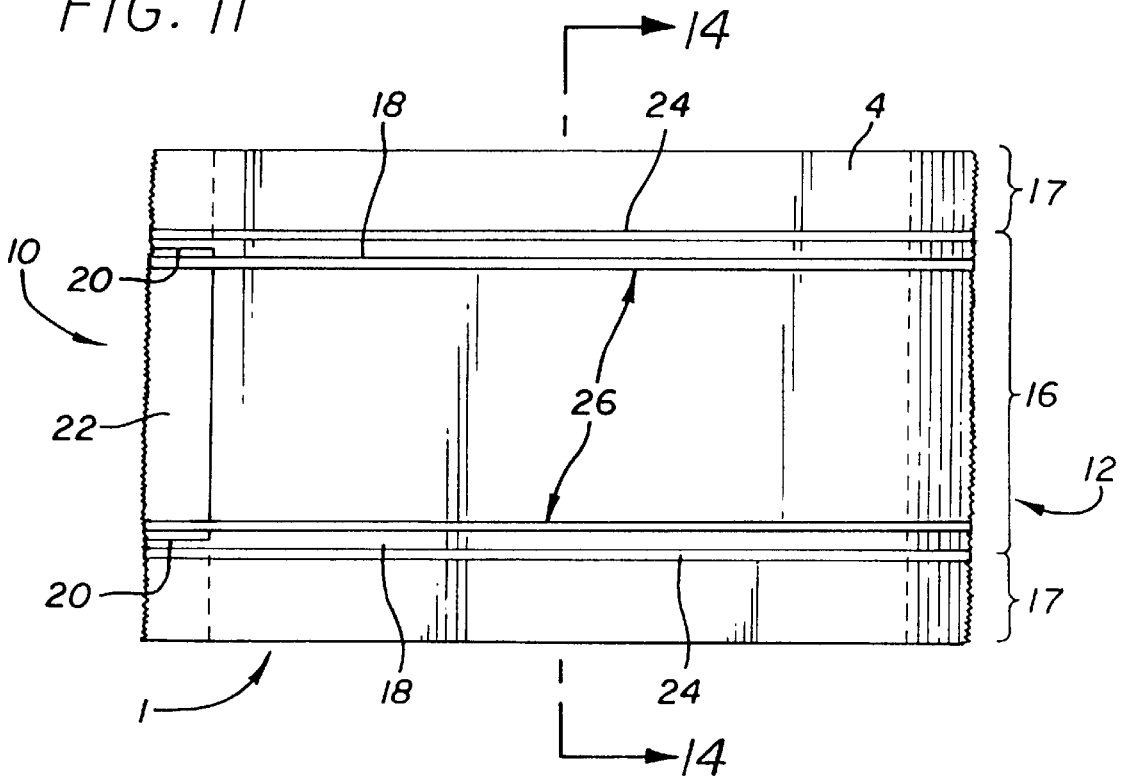
FIG. 11 is a plane view illustrating an alternative embodiment of the invention with two pairs of reinforcement strips adhered to the back panel defining channels for the separation lines between adjacent reinforcement strips.
Figure 12:
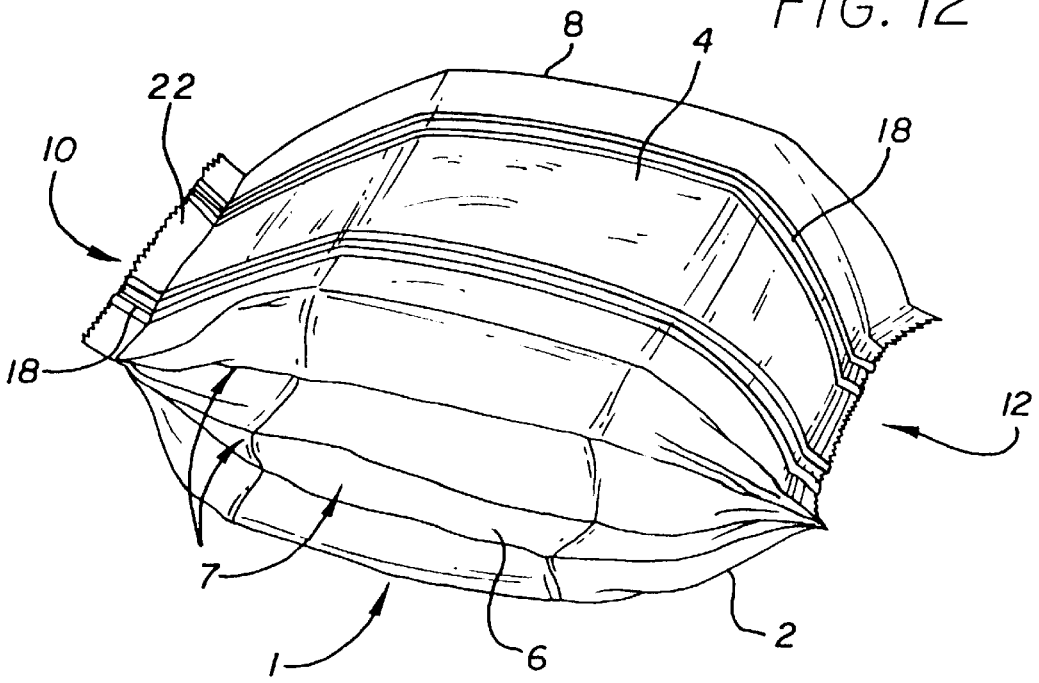
FIG. 12 is a pictorial illustration showing the package of FIG. 11 in perspective, after it has been expanded by popping the corn.
Figure 13:
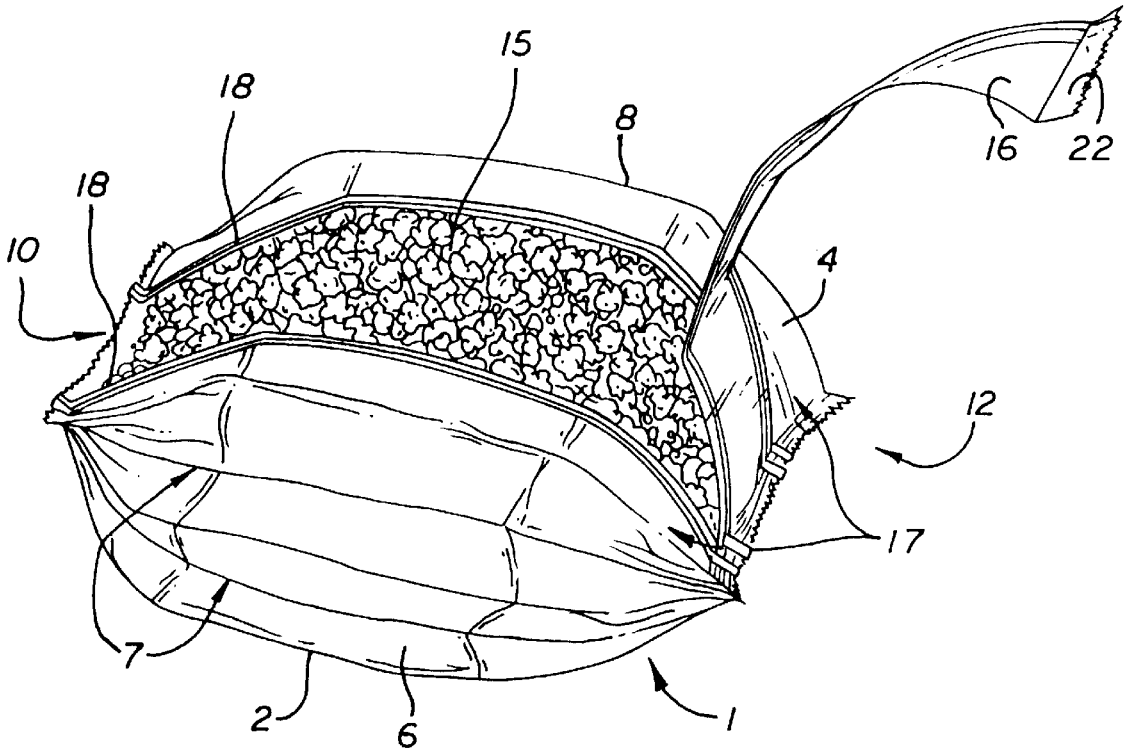
FIG. 13 is a pictorial illustration, similar to FIG. 12, after the middle section of the back panel has been removed to allow access to the prepared popcorn within.
Figure 14:
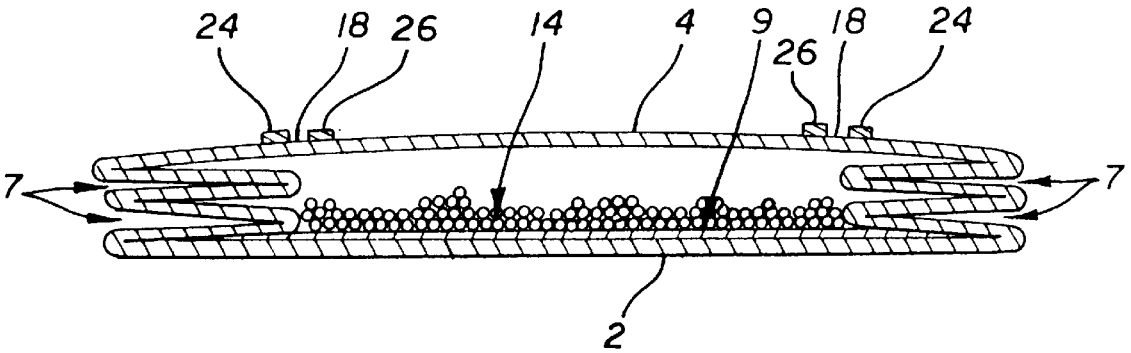
FIG. 14 is a cross-sectional side view of the package taken along the line 14—14 of FIG. 11.

In two other embodiments of this invention, illustrated in FIGS. 7–10, no reinforcement strips are used at all. Rather, the material of the back panel 4 itself is weakened along separation lines 18. This can be accomplished by using score lines 32 (FIGS. 7–8) or perforations 31 (FIGS. 9–10) to define separation lines 18. Perforations are advantageous in that they provide a more significant reduction in strength to facilitate tearing, but they also create a possibility that the shortening may leak through, particularly when liquefied under heat. Moreover, care must be taken not to weaken back panel 4 so much that it might prematurely split during the popping process or before. These problems can be addressed with a cover strip 33 which is applied over the perforations 31, as shown in FIGS. 9–10. A tab can also be included on the end of cover strip 33 to provide a handhold by which the cover strips can be removed prior to tearing middle section 16 off package 1.

When the package 1 is to be used by a consumer, it is placed in a microwave oven with front panel 2 facing downward. As energy is absorbed by the charge of popcorn kernels 14, the interior moisture content of the kernels is converted into steam, the pressure of which eventually ruptures the tough outer layer or pericarp of the kernels. The soft inner starches then rapidly expand to form the white fluffy material commonly thought of as popcorn. Initiating and speeding this process is the susceptor 9 which converts a portion of the microwave energy into heat to raise the temperature of the kernels. As the steam from the initial pops fills the package 1, the package is forced to expand by straightening and unfolding the gussets 7 of the side panels 6 and 8, creating a vertical space of considerable height above the front panel 2 to permit free and unrestricted popping action until the package reaches its fully expanded shape, as illustrated in FIGS. 2–3.

After the package 1 has been removed from the oven, the consumer can convert it into a serving vessel. Since no adhesive was placed between the incisions 20, the pull tab 22 will remain free of the front panel 2. Thus it can be used as a hand hold to pull the top end 10 of the middle section 16 away from the remainder of the package 1. This action initiates a tearing action at the base of each incision 20 which follows the separation lines 18 all the way down the back panel 4. When the tears reach the adhesive that joins the bottom ends 12 of the front panel 2 and the back panel 4, one of several things can happen. The adhesive can give way such that the bottom end of the middle section 16 will detach from package 1; the middle section can be torn along side the adhesive to remove all but the bottom end 12; or the middle section 16 can simply remain attached to the remainder of the package. Any one of these possibilities will provide the consumer with access to the popcorn through the opening thus formed.

With the middle section 16 removed, the consumer can reach directly into the package 1 to access the exposed popcorn 15. This is advantageous compared to opening the package 1 from top end 10, as the consumer will have far less contact with the interior surfaces of the package. Moreover, the consumer can conveniently add seasonings or toppings to the exposed popcorn 15 before eating. Such seasonings or toppings can include salt, butter, butter substitutes or caramel.

Although the invention has been described in detail with reference only to certain embodiments, those skilled in the art will appreciate that various modifications can be made without departing from the spirit of the invention. With such possibilities in mind, the invention is defined with reference to the following claims.

I claim:

1. A combination of a charge of popcorn kernels to be popped by microwave energy, and an expandable microwave popcorn package containing the charge and package capable of storing the charge before the kernels are popped, expanding while the kernels are popped and converting into a serving vessel for the resulting edible popcorn after the kernels are popped, the combination comprising:

a charge of popcorn kernels prone to popping upon the application of energy thereto;

a front panel having two side edges, a top end and a bottom end;

a back panel having two side edges, a top end connected to the top end of the front panel, and a bottom end;

two side panels, each connecting the side edges of the front and back panels so as to enclose the charge; and, two separation lines extending from the top end to the bottom end of the back panel, thereby delineating a middle section between two outer sections of the back panel;

wherein each side panel includes multiple inwardly directed folds forming multiple gussets that permit the package to be formed into a substantially flat configuration prior to the popping of the kernels, and expand to increase the volume of the bag during the popping of the kernels;

wherein the width of each outer section is substantially the same as the width of the gussets in the adjacent side panel, such that the separation lines are located directly above the inwardly directed folds in the adjacent side panel when the package is in the substantially flat configuration; and, wherein the package is substantially weaker along the separation lines than immediately adjacent the separation lines, such that after the popping process a tear initiated along the separation lines will tend to continue along the separation lines, thereby detaching the middle section from the outer sections to provide access to the interior of the package and the popcorn within the package.

2. The combination of claim 1 further comprising two outer reinforcement strips, each adhered to an edge of an outer section immediately adjacent a corresponding separation line, thereby increasing the strength of these edges of the outer sections.

3. The combination of claim 2 wherein the separation lines are defined by score lines impressed in the back panel.

4. The combination of claim 2 further comprising two inner reinforcement strips, one adhered to each edge of the middle section immediately adjacent a corresponding separation line, thereby increasing the strength of the edges of the middle section.

5. The combination of claim 4 wherein the inner and outer reinforcement strips are formed of pressure sensitive tape.

6. The combination of claim 1 further comprising:

two reinforcement strips, each adhered to the back panel along a separation line and each having perforations extending longitudinally along the center thereof;

wherein the perforations of the reinforcement strips define the separation lines.

7. The combination of claim 1 wherein the separation lines are defined by perforations in the back panel.

8. The combination of claim 7 further comprising two cover strips adhered to the back panel along the separation lines and overlapping the adjacent edges of the middle and outer sections, thereby preventing leakage through the perforations prior to the removal of the middle section.

9. The combination of claim 1 wherein the separation lines are defined by score lines in the back panel.

10. The combination of claim 1 further comprising a pull tab formed by a part of the top end of the back panel and forming an extension of the middle section, the ends of the pull tab being defined by incisions in the back panel, the pull tab providing a hand hold by which the top end of the back panel can be separated from the top end of the front panel.

11. The combination of claim 10 wherein the pull tab is not adhered to the top end of the front panel.

12. The combination of claim 1 further comprising a susceptor mounted on the front panel.

13. A combination of a charge of popcorn kernels to be popped by microwave energy and an expandable microwave popcorn package containing the charge and capable of storing the charge before the kernels are popped, expanding while the kernels are popped and converting into a serving vessel for serving the resulting popcorn after the kernels are popped, the combination comprising:

a charge of popcorn kernels prone to popping upon the application of energy thereto;

a front panel having two side edges, a top end and a bottom end;

a back panel having two side edges, a top end connected to the lop end of the front panel, and a bottom end connected to the bottom end of the front panel;

two side panels, each connecting the side edges of the front and back panels to enclose the charge, and each side panel including multiple inwardly directed folds forming multiple gussets that permit the package to be formed into a substantially flat configuration prior to the popping of the kernels, and expand to permit the volume of the bag to increase during thc popping of the kernels;

a susceptor mounted on the front panel;

two parallel separation lines extending from the top end to the bottom end of the back panel, thereby delineating a rectangular middle section between two outer sections of the back panel; and two outer reinforcement strips, one adhered to each outer section immediately adjacent a corresponding separation line, thereby increasing the tear strength of portions of the outer sections to which the reinforcement strips are applied;

wherein the package is substantially weaker along the separation lines than immediately adjacent the separation lines such that if the top end of the middle section is pulled away from the remainder of the package, the back panel will tear along the separation lines to the bottom end, thereby detaching the middle section from the outer sections to provide access to the interior of the package and the popcorn.

14. The combination of claim 13 wherein the separation lines are defined by two score lines impressed in the back panel.

15. The combination of claim 13 further comprising two inner reinforcement strips, one adhered to each edge of the middle section immediately adjacent the corresponding separation line, thereby increasing the strength of the edges of the middle section such that when the middle section is torn from the outer sections, the tears will tend not deviate from the separation lines onto the middle section.

16. The combination of claim 13 wherein the separation lines are defined by two lines of perforations in the back panel.

17. The combination of claim 16 further comprising two cover strips adhered to the back panel along the separation lines and overlapping the adjacent edges of the middle and outer sections, thereby preventing leakage through the perforations and improving the strength of the back panel prior to the removal of the middle section.

18. A combination of a charge of popcorn kernels and other edible ingredients and an expandable microwave popcorn package containing the charge and capable of storing the charge before the kernels are popped, expanding while the kernels are popped and converting into a serving vessel for serving the resulting popcorn after the kernels are popped, the combination comprising:

a charge of popcorn kernels prone to popping upon the application of energy thereto and other edible ingredients;

a front panel having two side edges, a top end and a bottom end;

a back panel having two side edges, a top end connected to the top end of the front panel, and a bottom end connected to the bottom end of the front panel;

two side panels, each connecting the side edges of the front and back panels, each side panel having multiple inwardly directed folds forming multiple gussets that permit the package to be formed into a substantially flat configuration prior to the popping of the kernels, and expand to increase the volume of the bag during the popping of the kernels;

a susceptor mounted on the front panel;

two parallel separation lines extending from the top end to the bottom end of the back panel, thereby delineating a rectangular middle section between two outer sections of the back panel; and two incisions in the top end of the back panel in alignment with the separation lines, the portion of the back panel between the incisions defining a pull tab that is not adhered to the top of the front panel;

wherein the width of each outer section is substantially the same as the width of the gussets in the adjacent side panel, whereby the separation lines are located directly above the inwardly directed folds in the adjacent side panel wherein the package is substantially weaker along the separation lines than immediately adjacent the separation lines such that when the top end of the middle section is pulled away from the remainder of the package by the pull tab, the back panel will tear from the base of the incisions along the separation lines to the bottom end, thereby detaching the middle section from the outer sections.

19. The combination of claim 18 further comprising reinforcement strips adjacent the corresponding separation lines, such that when the middle section is torn from the outer sections, the tears will tend not to deviate from the separation lines.

20. The combination of claim 18 wherein the separation lines are defined by two score lines in the back panel.

* * * * *

UNITED STATES PATENT AND TRADEMARK OFFICE

CERTIFICATE OF CORRECTION

PATENT NO. : 6,060,095

DATED : May 9, 2000

INVENTOR(S) : Cynthia Scrimager

It is certified that error appears in the above-indentified patent and that said Letters Patent is hereby corrected as shown below:

| COL | LINE | |
|---|---|---|
| 10 | 57 | "lop" should read --top-- |

Signed and Sealed this

Third Day of April, 2001

*Attest:*

Nicholas P. Godici

NICHOLAS P. GODICI

*Attesting Officer*

*Acting Director of the United States Patent and Trademark Office*